US010400955B2

(12) United States Patent
Kogon

(10) Patent No.: US 10,400,955 B2
(45) Date of Patent: Sep. 3, 2019

(54) SOLVENT DEPRESSURIZATION DEVICES, SYSTEM, AND METHODS

(71) Applicant: Boris David Kogon, Seattle, WA (US)

(72) Inventor: Boris David Kogon, Seattle, WA (US)

( * ) Notice: Subject to any disclaimer, the term of this patent is extended or adjusted under 35 U.S.C. 154(b) by 99 days.

(21) Appl. No.: 15/643,162

(22) Filed: Jul. 6, 2017

(65) Prior Publication Data

US 2018/0010737 A1 Jan. 11, 2018

Related U.S. Application Data

(60) Provisional application No. 62/360,737, filed on Jul. 11, 2016.

(51) Int. Cl.
*F17C 7/04* (2006.01)
*F17C 9/00* (2006.01)
(Continued)

(52) U.S. Cl.
CPC ..... *F17C 7/04* (2013.01); *F17C 3/00* (2013.01); *F17C 6/00* (2013.01); *F17C 9/00* (2013.01);
(Continued)

(58) Field of Classification Search
CPC .... F17C 7/04; F17C 13/025; F17C 227/0302; F17C 13/04; F17C 3/00; F17C 2223/0123; F17C 2223/033; F17C 2223/2225; F17C 2223/035; F17C 2250/01; F17C 2205/0146; F17C 2270/0171; F17C 2227/0135; F17C 2227/0337; F17C 2250/043; F17C 2205/0323; F17C 2205/0326; F17C 2205/0329; F17C 2205/0332;
(Continued)

(56) References Cited

U.S. PATENT DOCUMENTS 2,316,251 A * 4/1943 Kahle ..... B01D 53/26 392/480
2,560,935 A * 7/1951 Dickinson ..... B01D 11/0203 554/16
(Continued)

OTHER PUBLICATIONS

"Gas holder" from Wikipedia, retrieved from the Internet on Apr. 9, 2018, at https://en.wikipedia.org/wiki/Gas_holder, 9 pages.

*Primary Examiner* — Reinaldo Sanchez-Medina
*Assistant Examiner* — David Colon-Morales
(74) *Attorney, Agent, or Firm* — Benedict R. Dugan; Lowe Graham Jones PLLC

(57) ABSTRACT

A solvent storage and depressurization system is described. The system allows a volume of solvent to be stored and used at low pressure, thereby providing safety benefits and regulatory simplicity. The system includes an external expansion tank that is located outside of an extraction facility and that contains a solvent. The system also includes an internal storage tank that is located inside of the extraction facility and that provides a solvent supply to a solvent user, such as a phytochemical extraction system. The external and internal tanks are separated and connected via a duplex manifold. The manifold allows gas below a first pressure level to pass from the external expansion tank to the internal storage tank, and allows gas above a second pressure level to pass from the internal storage tank back to the external expansion tank, wherein the second pressure level is greater than the first pressure level.

18 Claims, 4 Drawing Sheets

(51) Int. Cl.

| | |
|---|---|
| ***F17C 13/02*** | (2006.01) |
| ***F17C 13/04*** | (2006.01) |
| ***F17C 3/00*** | (2006.01) |
| ***F17C 6/00*** | (2006.01) |

(52) U.S. Cl.
CPC ..... *F17C 13/025* (2013.01); *F17C 13/04* (2013.01); *F17C 2201/0109* (2013.01); *F17C 2201/035* (2013.01); *F17C 2201/054* (2013.01); *F17C 2205/0146* (2013.01); *F17C 2205/0157* (2013.01); *F17C 2221/035* (2013.01); *F17C 2223/0123* (2013.01); *F17C 2223/0153* (2013.01); *F17C 2223/031* (2013.01); *F17C 2223/033* (2013.01); *F17C 2225/0153* (2013.01); *F17C 2225/033* (2013.01); *F17C 2227/0135* (2013.01); *F17C 2227/0302* (2013.01); *F17C 2227/0337* (2013.01); *F17C 2250/01* (2013.01); *F17C 2250/043* (2013.01); *F17C 2250/0626* (2013.01); *F17C 2260/021* (2013.01); *F17C 2265/061* (2013.01); *F17C 2270/0134* (2013.01); *F17C 2270/0171* (2013.01); *Y10T 137/87563* (2015.04)

(58) Field of Classification Search
CPC ..... F17C 2205/0335; F17C 5/06; Y10T 137/86187; Y10T 137/86324; Y10T 137/86574; Y10T 137/87233; Y10T 137/87241; Y10T 137/8733; Y10T 137/87563
See application file for complete search history.

(56) References Cited

U.S. PATENT DOCUMENTS 2,658,907 A * 11/1953 Palmer ..... C11B 7/005 554/175
2,976,695 A * 3/1961 Meade ..... F17C 13/02 62/393
3,527,379 A * 9/1970 Mair ..... F17C 13/025 137/587
3,570,700 A * 3/1971 Yamamoto ..... F17C 3/022 220/560.06
5,454,408 A 10/1995 DiBella et al.
5,516,923 A * 5/1996 Hebert ..... B01D 11/028 554/11
6,260,568 B1 * 7/2001 Hsu ..... F17C 13/045 137/113
6,453,924 B1 * 9/2002 Wang ..... F17C 11/00 137/1
7,263,839 B2 * 9/2007 Overweg ..... F25D 29/001 62/259.2
7,943,190 B2 * 5/2011 Mazza ..... B01D 11/0207 424/725
8,256,449 B2 * 9/2012 Handa ..... F17C 5/06 137/338
8,322,357 B2 * 12/2012 Chen ..... F17C 13/04 137/14
8,327,865 B2 * 12/2012 Stenmark ..... F17C 1/00 137/15.18
8,468,840 B2 * 6/2013 Burgers ..... F17C 5/06 137/572
9,757,664 B2 * 9/2017 McGhee ..... B01D 11/0207
9,856,835 B1 * 1/2018 Coldren ..... F02M 37/0064
9,982,935 B2 * 5/2018 Webber ..... F25D 19/006
2015/0211684 A1 * 7/2015 Santos ..... F17C 5/06 137/1
2015/0276127 A1 * 10/2015 Shibayama ..... F17B 1/26 277/634
2016/0245459 A1 * 8/2016 Grimmer ..... F17C 5/06
2017/0312327 A1 * 11/2017 Jones ..... C11B 1/04
2018/0008906 A1 * 1/2018 Kogon ..... B01D 11/0219
2018/0128210 A1 * 5/2018 Garner ..... F17C 9/02

* cited by examiner

SOLVENT DEPRESSURIZATION DEVICES, SYSTEM, AND METHODS

PRIORITY CLAIM

This application claims the benefit of U.S. Provisional Patent Application No. 62/360,737, entitled "Solvent Depressurization Devices, System, and Methods," filed on Jul. 11, 2016, the content of which is incorporated herein by reference in its entirety.

TECHNICAL FIELD

The present disclosure relates to solvent depressurization and storage systems, and more particularly a system that stores and provides solvent at low pressure for use in the context of a solvent-based phytochemical extraction system or other solvent-based industrial process.

BACKGROUND

Many phytochemical extraction processes rely on volatile solvents, such as propane or butane. As such solvents are gaseous at ambient pressure, they are typically stored under pressure, in liquid form. Facilities that utilize solvents stored and transported under pressure need to be designed and implemented to meet high-pressure safety standards (e.g., American Society of Mechanical Engineers Boiler & Pressure Vessel Code), resulting in considerable start-up costs. The techniques described herein address the shortcomings with the conventional approaches to solvent storage, delivery, and utilization.

DETAILED DESCRIPTION

Figure 1:
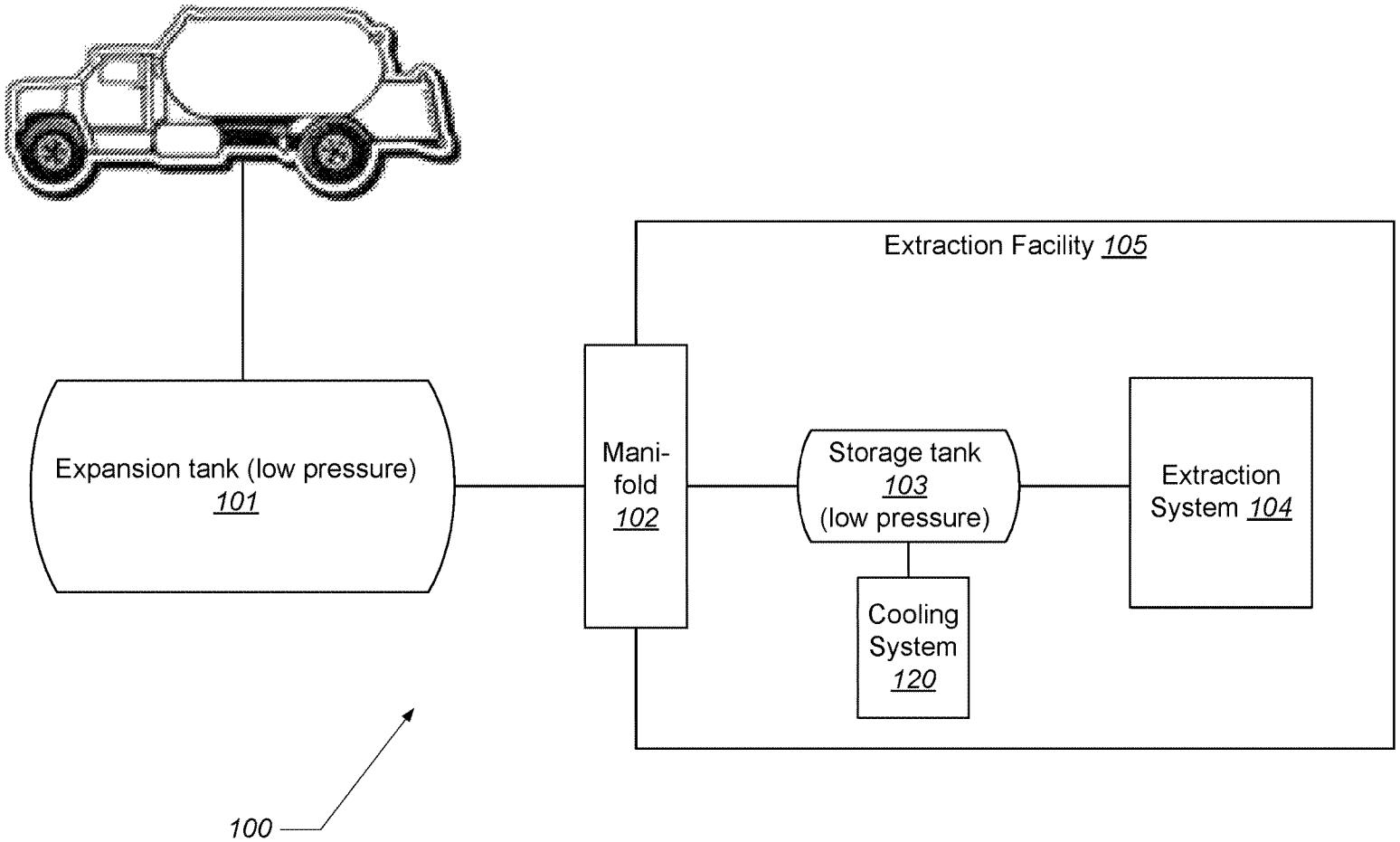
FIG. 1 illustrates a solvent depressurization system according to an example embodiment.

FIG. 1 illustrates a solvent depressurization system 100 according to an example embodiment. The system 100 allows a mass of solvent to be stored on site at an extraction facility, without the need to comply with high-pressure safety standards and the attendant costs.

As shown in FIG. 1, the system 100 includes an external, pre-engineered propane tank ("expansion tank") 101, a manifold 102, a storage tank 103, an extraction system 104, and a cooling system 120. The extraction system 100 may be configured to extract oils and other materials from plant matter, by running a solvent through plant material to strip out the desired materials, or by other techniques known in the art. Example systems and methods for solvent-based phytochemical extraction are described in U.S. patent application Ser. No. 15/339,816, entitled "PHYTOCHEMICAL EXTRACTION SYSTEMS, METHODS, AND DEVICES" and filed on Oct. 31, 2016, which is incorporated herein by reference in its entirety. The extraction system 100 in some embodiments is configured to produce *cannabis* extract from *cannabis* plant material.

The expansion tank 101 is placed outside the working environment ("extraction facility") 105. Such tanks are available in several standard sizes (e.g., 250, 320, 500, and 1000 gallons), and are engineered to hold liquid propane at high pressure (e.g., 350-400 psi). It is also possible to instead use a lower pressure tank, since the described system functions far below the rated pressure of pre-engineered propane tanks. The facility 105 is typically an enclosed building, but could also be an open air area at which the extraction tank 103 and system 104 are located.

The expansion tank 101 is fluidly connected via stainless steel tubing (e.g., ½"×0.035" wall) or similar conduit to the manifold 102. The manifold 102 is further described with respect to FIG. 2, below. The manifold 102 is fluidly connected to the liquid storage tank 103, which is located inside of the facility 105. The storage tank 103 is cooled down using the cooling system 120 to −40 to −100 F during operation.

Initially the entire system 100 is pulled down to a deep vacuum. The vacuum may be established by way of a pump, not shown. Then, the evacuated system is charged (e.g., from a delivery truck or fixed connection to a solvent source) with a certain mass of solvent: butane, isobutane, propane, or a mix thereof. The suitable mass of solvent is calculated by considering the volume that mass will expand to in vapor form at the ambient air temperature, up to a certain maximum allowed pressure. This is a simple calculation involving Boyle's Law, and a gas conversion chart that describes the relationship between a mass (or volume) of liquid solvent and its corresponding volume in gaseous form. For example, a gallon of liquid propane yields approximately 36 cubic feet of gas at a temperature of 60 F. Similarly, a gallon of liquid butane yields approximately 31 cubic feet of gas at a temperature of 60 F.

If the system 100 is never raised above 1 atm relative (2 atm absolute), then the entire system is never considered a "pressure vessel," and does not need to conform to any ASME ("American Society of Mechanical Engineers") pressure vessel rules to be certified for use. The system 100 thus becomes a low-pressure or unpressurized system, and therefore not subject to the regulations that govern the configuration and operation of high pressure systems.

Figure 2:
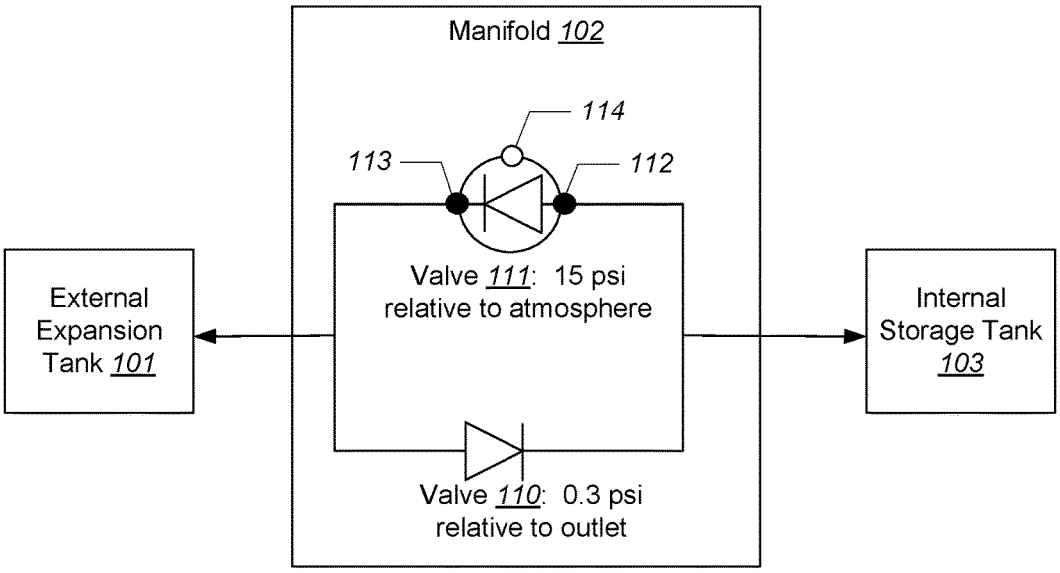
FIG. 2 illustrates a duplex manifold according to an example embodiment.

FIG. 2 illustrates a duplex manifold according to an example embodiment. As seen in FIG. 1, the duplex manifold 102 separates the external expansion tank 101 and the internal storage tank 103. The manifold 102 separates the system 100 into an external portion and an internal portion. The external portion includes external expansion tank 101. The internal portion includes the internal storage tank 103 and the extraction system 104. Although the terms "internal" and "external" are used, these terms do not require that the respective portion of the system be located inside or outside of a building or other structure, even though they typically will be.

The manifold 102 includes two valves 110 and 111. Valve 110 is a one-way check valve with low cracking pressure leading in (e.g., 0.3 psi). Valve 110 is relative or differential in operation. That is, the valve 110 opens when the difference in pressure between inlet and outlet exceeds the cracking pressure, in this example 0.3 psi.

Valve 111 is a one-way valve that has three ports: an input port 112, an output port 113, and a test port 114. Valve 111 measures the difference between the input port 112 and the test port 114, and releases from the input port 112 to the output port 113 (connected to the external expansion tank 101) so long as the measured pressure exceeds a specified limit. In this example, the test port 114 is open to the atmosphere, and the release pressure is set to 15 psi. This means that valve 111 will release gas to the external expansion tank (via the output port 113) whenever the pressure on the internal portion of the system exceeds 15 psi above atmospheric pressure. Other pressure ranges or limits can be used. For example, depending on the solvent mix, a higher release pressure (e.g., 30-50 psi) can be used for valve 111.

The manifold 102 guarantees that the internal portion of the system 100 never experiences a pressure greater than some limit established by valve 111 (e.g., 15 psi). If the pressure in the internal portion exceeds the specified limit, valve 111 vents gas to the expansion tank 101. If the pressure on the external portion of the system 100 exceeds another specified limit, then various options are contemplated, including venting excess gas into the atmosphere, or capturing excess gas in a secondary tank, as described below.

At ambient temperatures, the liquid solvent charged into the external expansion tank 101 all changes to vapor phase and expands to fill both the external expansion tank 101 and the internal storage tank 103. At this point the gas within the system 100 will be at its maximum allowable low-pressure, as determined by the mass of solvent charging the system 100.

When the cooling system 120 is started, the internal storage tank 103 will be reduced to −40 to −100 F, condensing and liquefying all of the solvent vapor throughout the system (via diffusion of gas molecules toward the tank 103). The liquefied solvent collects in the inside storage tank 103, where it can be used at a cold temperature in the extraction system 104. The vapor pressure of cold butane is below 1 atm, so this is considered a partial vacuum vessel, rather than a pressure vessel. The vapor pressure of N-butane is −25 to −28 in Hg at the described low temperatures.

When the cooling system 120 is turned off, or fails (e.g., due to mechanical failure or a power outage), the pressure will rise as the solvent warms and evaporates. As the pressure rises beyond the limit pressure of the manifold 102, the gas will pass through the manifold 102 and then to the external vapor storage tank 101.

Pre-engineered external expansion tanks typically include a pressure relief set to around 350-400 psi. In some embodiments, the external expansion tank is also fitted with a secondary relief valve set to a cracking pressure of 100-150 psi. This guarantees that the internal portion of the system will never experience pressures greater than the level set by the secondary valve. Another advantage is that emergency pressure relief takes place external to the facility.

Figure 3:
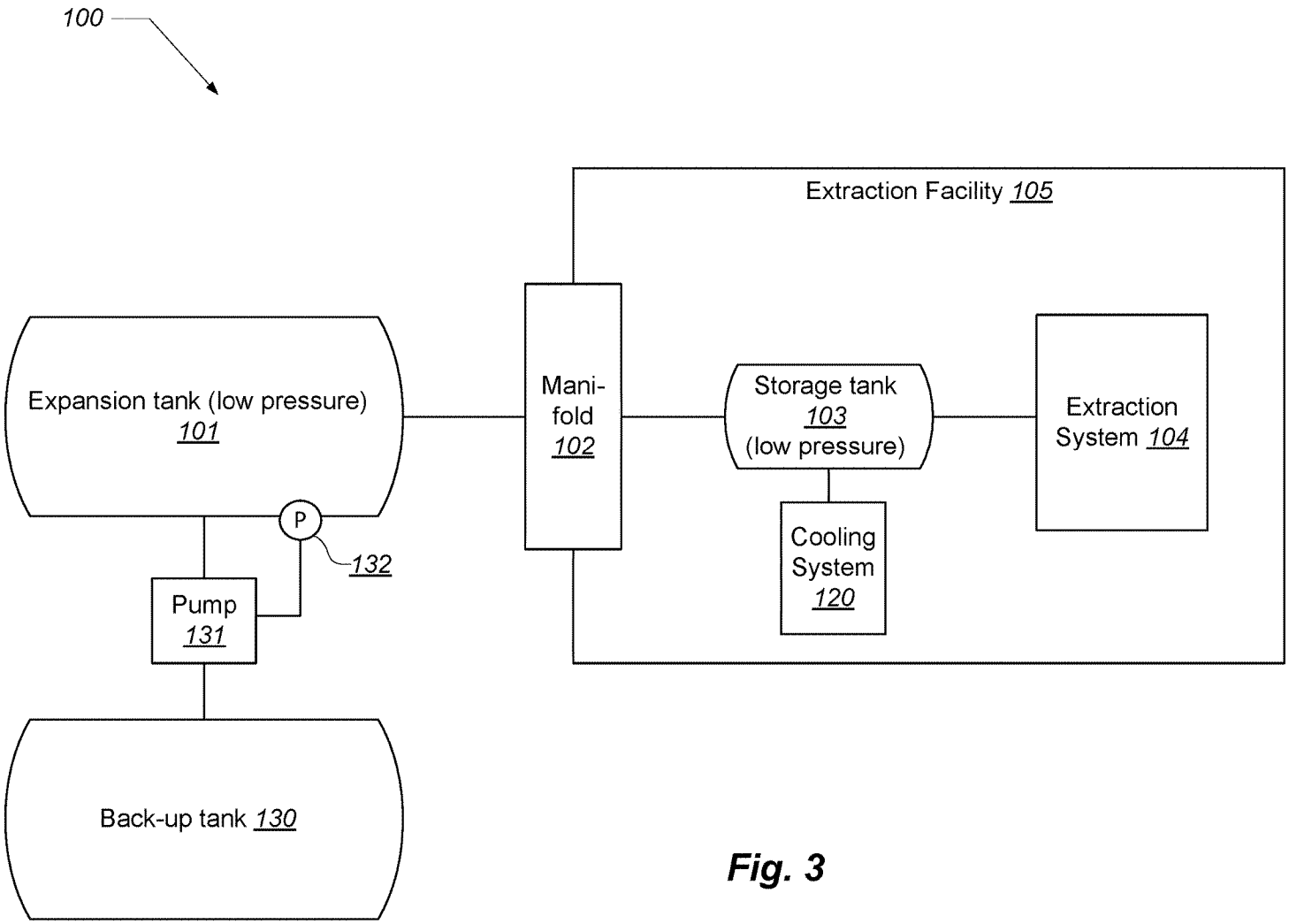
FIG. 3 illustrates an embodiment that includes a secondary external back-up tank.

As shown in FIG. 3, some embodiments include a secondary external ("back-up tank") 130. In this case, the primary external tank 101 includes a sensor 132 and an associated pump 131 that moves (recompresses) solvent from the expansion tank 101 to the back-up tank 130, such as in the case of emergency or simply to purge the system of all solvent (e.g., when the operator wants to utilize a different type or mix of solvent).

The described system provides numerous benefits in the case of fire. A fire inside of the facility heats and gasifies solvent in the internal storage tank 103, which causes all solvent to exit the facility via the manifold, rendering the internal environment relatively safe.

Expressed in terms of the ideal gas law (PV=nRT), the system internal to the extraction facility can be modeled thusly: R is constant; V of the system is fixed; P is held constant by the manifold at 15 psi (for example); therefore as T increases, n must decrease, which occurs by gas passing through the manifold back to the external expansion tank 101.

Establishing a low pressure environment on the inside of the facility 105 provides substantial economic, engineering, and industrial process advantages. First, because the internal facility operates at low pressure, equipment that is not certified for high pressure use may be employed, yielding savings in terms of certification, inspection, engineering effort, and the like. The low pressure characteristic may also allow facilities to be located in building or activity zones where high pressure extraction facilities would not ordinarily be authorized due to safety concerns. The low pressure environment also allows considerable design flexibility in terms of parts and components.

In general, when the described system experiences a high pressure condition, solvent is simply recaptured by the external expansion tank 101, rather than being vented into the environment, as is typical in the industry. This property reduces pollution and increases safety for the surrounding community.

Figure 4:
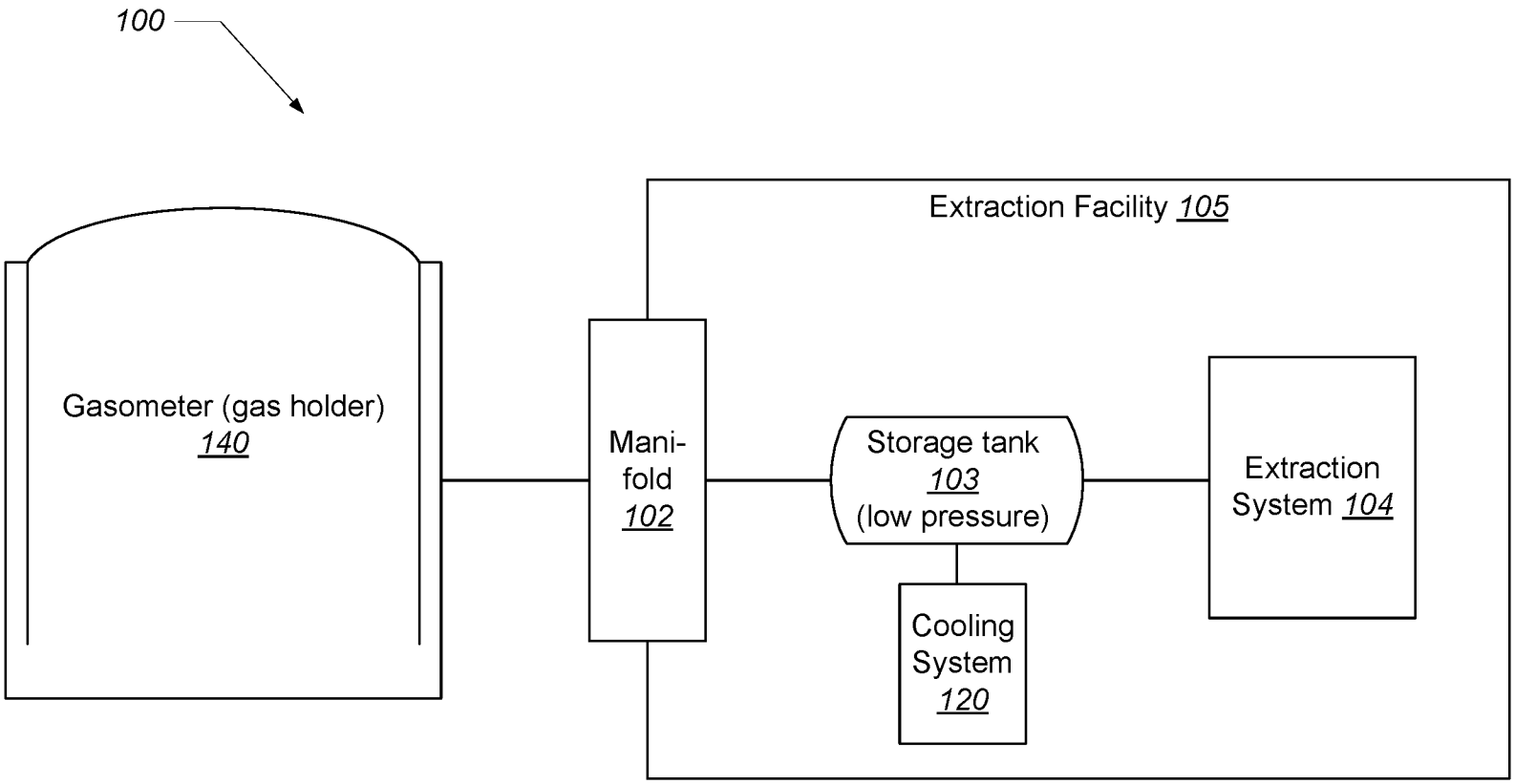
FIG. 4 illustrates an embodiment that uses a gasometer as an external storage tank.

As shown in FIG. 4, some embodiments employ a gasometer (also known as a "gas holder") 140 in place of the external expansion tank 101. A gasometer 140 is a large container that stores gas at near atmospheric pressure, by having a variable volume. The volume of the gasometer changes based on the quantity of gas stored, so as to maintain a near constant pressure within the gasometer. (See, https://en.wikipedia.org/wiki/Gas_holder.)

A pre-engineered propane tank employed as tank 101 has a fixed volume, resulting in variable pressure conditions in the system, depending primarily on the temperature of the internal storage tank 103. In contrast, a gasometer used as tank 101 yields a system having variable volume, fixed pressure. As the internal storage tank 103 is cooled, condensing the gas in the system, the gasometer volume decreases, maintaining an overall constant (or substantially constant) pressure.

Some embodiments provide a method for of operating the described solvent depressurization system. The process first evacuates the solvent depressurization system, but using a pump or similar mechanism to remove substantially all of the air. Different internal pressure levels may be utilized, including less than one of 0.1, 0.09, 0.08, 0.7, 0.06, 0.05, 0.04, 0.03, 0.02, 0.01 atmosphere.

The process next charges the external expansion tank with a mass of solvent (e.g., propane, butane), wherein the mass of solvent is less than the amount that would raise the internal pressure of the solvent depressurization system to twice atmospheric pressure at ambient temperature (e.g., 65-80 degrees).

The process then cools the internal storage tank, thereby causing gaseous solvent to flow from the external expansion to the internal storage tank via the manifold, wherein the gaseous solvent condenses in the internal storage tank. The internal storage tank is cooled to below the boiling point of the solvent, for example less than −42 degrees C. for propane or −1 degrees C. for butane.

The process then provides, from the internal storage tank, the solvent in liquid form to the solvent user. The solvent user may be a phytochemical extraction system or similar system/process that utilizes solvent in liquid form.

After utilization of the solvent, the process warms the internal storage tank, thereby causing solvent to evaporate and flow to the external expansion tank via the manifold. The internal storage tank is typically warmed passively. That is, no specific warming apparatus is needed, as it is sufficient to turn off the cooling system for the internal storage tank and allow the tank to warm in the environment of the system facility.

Note that while embodiments have been described as providing solvent in the context of a phytochemical extraction system and process, the described system is not limited to use only in that context. In particular, the described system can store and provide solvent (or other volatile material) for any industrial process that requires a ready source of solvent or similarly volatile material.

While embodiments of the invention have been illustrated and described, as noted above, many changes can be made without departing from the spirit and scope of the invention. Accordingly, the scope of the invention is not limited by the above disclosure.

The invention claimed is:

1. A solvent depressurization system comprising:

an external expansion tank that is located outside of an extraction facility and that contains a solvent;

an internal storage tank that is located inside of the extraction facility and that provides a solvent supply to a solvent user; and a manifold that is coupled via a first conduit to the expansion tank and coupled via a second conduit to the storage tank, wherein the manifold is configured to allow gas below a first pressure level to pass from the external expansion tank to the internal storage tank, and to allow gas above a second pressure level to pass from the internal storage tank back to the external expansion tank, wherein the second pressure level is greater than the first pressure level, wherein the manifold comprises:

a first one-way valve that has a cracking pressure set to the first pressure level and that allows gas at higher than the first pressure level to pass from the external expansion tank to the internal storage tank; and a second one-way valve that has a cracking pressure set to the second pressure level and that allows gas at higher than the second pressure level to pass from the internal storage tank to the external expansion tank, wherein the second pressure level is measured relative to atmospheric pressure.

2. The solvent depressurization system of claim 1, wherein the solvent is propane or butane.

3. The solvent depressurization system of claim 1, wherein the solvent user is a phytochemical extraction system.

4. The solvent depressurization system of claim 1, wherein the first pressure level is 0.3 psi and wherein the second pressure level is 15 psi.

5. The solvent depressurization system of claim 1, wherein the second one-way valve measures the second pressure level with respect to a test port that samples atmospheric pressure.

6. The solvent depressurization system of claim 1, further comprising:

a cooling system configured to cool the internal storage tank to below −40 F, thereby drawing gaseous solvent from the external expansion tank, through the manifold, and into the internal storage tank and condensing it into its liquid state for collection in the internal storage tank.

7. The solvent depressurization system of claim 6, wherein the system is configured to, in response to non-operation of the cooling system, transport via the manifold gaseous solvent at pressures above the second pressure level back to the external expansion tank.

8. The solvent depressurization system of claim 1, wherein the external expansion tank is a propane storage tank having a volume of at least 200 gallons.

9. The solvent depressurization system of claim 1, wherein the external expansion tank is a gasometer that includes a gas storage chamber having a variable volume.

10. The solvent depressurization system of claim 1, further comprising:

a pressure sensor that measures the pressure in the external expansion tank;

a back-up tank; and a pump coupled to the external expansion tank and the back-up tank, wherein the system is configured to automatically pump solvent from the external expansion tank to the back-up tank when the pressure sensor measures a pressure higher than a third pressure level.

11. A method of operating a solvent depressurization system, the method comprising: evacuating the solvent depressurization system comprising: an external expansion tank that is located outside of an extraction facility and that contains a solvent; an internal storage tank that is located inside of the extraction facility and that provides a solvent supply to a solvent user; and a manifold that is coupled via a first conduit to the expansion tank and coupled via a second conduit to the storage tank, wherein the manifold is configured to allow gas below a first pressure level to pass from the external expansion tank to the internal storage tank, and to allow gas above a second pressure level to pass from the internal storage tank back to the external expansion tank, wherein the second pressure level is greater than the first pressure level; charging the external expansion tank with a mass of solvent, wherein the mass of solvent is less than the amount that would raise the internal pressure of the solvent depressurization system to twice atmospheric pressure at ambient temperature; cooling the internal storage tank, thereby causing gaseous solvent to flow from the external expansion to the internal storage tank via the manifold, wherein the gaseous solvent condenses in the internal storage tank; providing, from the internal storage tank, the solvent in liquid form to the solvent user; and warming the internal storage tank, thereby causing solvent to evaporate and flow to the external expansion tank via the manifold.

12. The method of claim 11, further comprising:

automatically and in response to a pressure in the external expansion tank that is higher than a third pressure level, pumping solvent from the external expansion tank to a back-up tank.

13. A solvent depressurization system comprising:

an external expansion tank that is located outside of an extraction facility and that contains a solvent;

an internal storage tank that is located inside of the extraction facility and that provides a solvent supply to a solvent user;

a manifold that is coupled via a first conduit to the expansion tank and coupled via a second conduit to the storage tank, wherein the manifold is configured to allow gas below a first pressure level to pass from the external expansion tank to the internal storage tank, and to allow gas above a second pressure level to pass from the internal storage tank back to the external expansion tank, wherein the second pressure level is greater than the first pressure level; and a cooling system configured to cool the internal storage tank to below −40 F, thereby drawing gaseous solvent from the external expansion tank, through the manifold, and into the internal storage tank and condensing it into its liquid state for collection in the internal storage tank.

14. The solvent depressurization system of claim 13, wherein the system is configured to, in response to non-operation of the cooling system, transport via the manifold gaseous solvent at pressures above the second pressure level back to the external expansion tank.

15. The solvent depressurization system of claim 13, wherein the external expansion tank is a propane storage tank having a volume of at least 200 gallons.

16. The solvent depressurization system of claim 13, wherein the manifold comprises:

a first one-way valve that has a cracking pressure set to the first pressure level and that allows gas at higher than the first pressure level to pass from the external expansion tank to the internal storage tank; and a second one-way valve that has a cracking pressure set to the second pressure level and that allows gas at higher than the second pressure level to pass from the internal storage tank to the external expansion tank, wherein the second pressure level is measured relative to atmospheric pressure.

17. The solvent depressurization system of claim 16, wherein the second one-way valve measures the second pressure level with respect to a test port that samples atmospheric pressure.

18. The solvent depressurization system of claim 13, further comprising:

a pressure sensor that measures the pressure in the external expansion tank;

a back-up tank; and a pump coupled to the external expansion tank and the back-up tank, wherein the system is configured to automatically pump solvent from the external expansion tank to the back-up tank when the pressure sensor measures a pressure higher than a third pressure level.

* * * * *